United States Patent [19]

Kumagai et al.

[11] Patent Number: 4,911,883

[45] Date of Patent: Mar. 27, 1990

[54] COLD WORKING STAINLESS STEEL

[75] Inventors: Kenichi Kumagai, Tokai; Yoshinobu Honkura, Kounan; Toru Matsuo; Kouji Murata, both of Tokai, all of Japan

[73] Assignee: Aichi Steel Work, Ltd., Tokai, Japan

[21] Appl. No.: 216,530

[22] Filed: Jul. 8, 1988

Related U.S. Application Data

[63] Continuation of Ser. No. 4,602, Dec. 9, 1986, abandoned, which is a continuation of Ser. No. 737,403, May 24, 1985, abandoned.

[30] Foreign Application Priority Data

May 31, 1984 [JP] Japan ..... 59-112656

[51] Int. Cl.[4] ..... C22C 38/42

[52] U.S. Cl. ..... 420/58; 420/35; 420/60; 420/45

[58] Field of Search ..... 420/58, 45, 60, 35; 148/327, 12 F

[56] References Cited

U.S. PATENT DOCUMENTS

| | | | |
|---|---|---|---|
| 3,282,684 | 11/1966 | Allen | 75/125 |
| 4,530,720 | 7/1985 | Moroishi et al. | 75/125 |

FOREIGN PATENT DOCUMENTS

| | | | |
|---|---|---|---|
| 53-10003 | 4/1978 | Japan | 75/125 |
| 55-28366 | 2/1980 | Japan | 75/125 |
| 55-31173 | 3/1980 | Japan | 75/125 |
| 56-146862 | 11/1981 | Japan | 75/125 |

*Primary Examiner*—Deborah Yee

*Attorney, Agent, or Firm*—Berman, Aisenberg & Platt

[57] ABSTRACT

Stainless steels possessing a superior cold workability and hot workability, which are yet economical. The stainless steels comprise not more than 0.04% carbon, not more than 0.60% silicon, 2.2–3.8% manganese, 2.5–4.0% copper, 6–8% nickel, 17–19% chromium, and the remainder being iron together with impurities. And, not more than 0.002% sulfur is decreased to provide stainless steels which possess superior corrosion resistance, and not more than 0.010% nitrogen are decreased in the stainless steels as required.

6 Claims, 3 Drawing Sheets

TENSILE STRENGTH (kg/mm²)
60
55
50
5.5Ni
6.5Ni
8Ni
9Ni
10Ni
0
5
8
10
Mn (%)

CRITICAL COMPRESSIBILITY (%)
85
80
75
10Ni
9Ni
8Ni
6.5Ni
5.5Ni
0
5
8
10
Mn (%)

17Cr-7Ni-3Mn-3Cu-0.01C-0.01N-0.30Si
CRITICAL COMPRESSIBILITY (%)
90
80
0.010
0.020
0.030
S (%)

COLD WORKING STAINLESS STEEL

RELATED APPLICATION

This application is a continuation of Ser. No. 004,602, filed 12/9/86, which is a continuation of Ser. No. 737,403, filed May 24, 1985, both now abandoned.

BACKGROUND OF THE INVENTION

1. Field of the Invention

This invention relates to stainless steels which are economical and superior in cold workability, corrosion resistance and hot workability and are utilized for such objects as screws.

2. Description of the Prior Art

Such austenitic stainless steels as 17.5 Cr-13 Ni steel (SUS $305J_1$), 18 Cr-9.5 Ni-3 Cu steel (SUSXM7) have been used for stainless steel wires for manufacturing screws. These steels, however, are expensive due to their high nickel content, although they are superior in cold workability, corrosion resistance and hot workability. Recently 17 Cr-6 Ni-6 Mn-2 Cu steel (SUSXM1) and 15.5 Cr-7.8 Ni-4 Mn-3 Cu steel, which contain less nickel, have been developed to lower the price of steel. In place of nickel, these steels contain 4–6% manganese (which forms an austenitic phase), and some of these steels have already been in actual use. The cold workability of these steels, which have tensile strengths of from 54–56 kg/mm$^2$, however, is inferior to that of SUSXM7. The corrosion resistance of these steels is not sufficient, either. Therefore, the development of austenitic stainless steels which possess superior cold workability and corrosion resistance (comparable to that of SUSXM7) and are also economical has been sought after.

Superior austenitic stainless steels have been developed by the present inventors as a result of research on the effects of carbon and the silicon, the relationship of nickel and manganese, and alloying balance of such elements as chromium, nickel, manganese, carbon, silicon, nitrogen, and copper in relation to cold workability, corrosion resistance and hot workability of austenitic stainless steels.

SUMMARY OF THE INVENTION

This invention involves decreasing carbon and silicon content to a minimal level. The high carbon and silicon content inhibit cold workability due to a solution strengthening effect. This invention shows that the carbon content is decreased to not more than 0.04%, the silicon content is decreased to not more than 0.60% (preferably between 0.20–0.40%) to provide a cold workability much better than that of the foregoing conventional steels.

Accordingly, it is a primary object of this invention to provide stainless steels which overcome the above objections of conventional steels.

It is a further object of this invention to provide stainless steels which possess superior cold workability.

It is a further object of this invention to provide stainless steels which possess superior hot workability.

It is a still further object of this invention to provide stainless steels which possess superior corrosion resistance.

It is another object of this invention to provide stainless steels which are economical.

The aforesaid objects of the present invention and other objects which will become apparent as the description proceeds are achieved by providing a cold working stainless steel comprising, by weight ratio, not more than 0.04% carbon, not more than 0.60% silicon, 2.2–3.8% manganese, 2.5–4.0% copper, 6–8% nickel, 17–19% chromium, the remainder being iron (together with impurities), and not more than 0.002% sulfur to provide stainless steels which possess superior corrosion resistance.

The present invention is a result of research on the effects of nickel, manganese and sulfur in relation to cold workability.

Optimal contents of manganese, nickel, and sulfur have been found by this research conducted with a 0.02 C-0.30 Si-3 Cu-17 Cr-0.008N steel, including 0.5–8% manganese, 5–10% nickel and 0.001–0.030% sulfur. The cold workability was evaluated by reformation resistance (generally substituted by tensile strength) during cold working and by critical compressibility.

BRIEF DESCRIPTION OF THE DRAWINGS

The exact nature of this invention, as well as other objects and advantages thereof, will be readily apparent from consideration of the following specification relating to the annexed drawings in which.

DETAILED DESCRIPTION OF THE INVENTION

Figure 1:
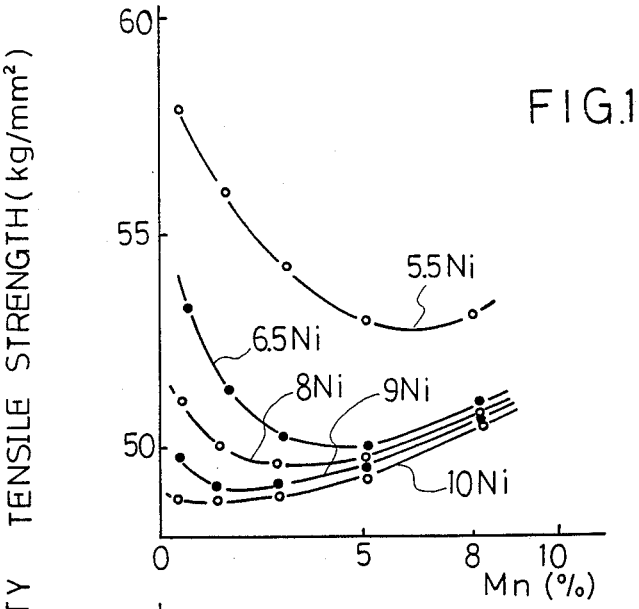
FIG. 1 is a graph illustrating the relationship of manganese content and tensile strength.

Referring now to the drawings, FIG. 1 illustrates the relationship of tensile strength and manganese and nickel content. The tensile strength decreases as the manganese content increases. The tensile strength is lowest when the manganese content is about 2–5%. And, the tensile strength becomes larger as the manganese content is further increased. The manganese content at which the tensile strength becomes lowest is higher in the steels with a low nickel content. The tensile strength of stainless steels containing 6–8% nickel is lowest when the manganese content is 2–4%.

Figure 2:
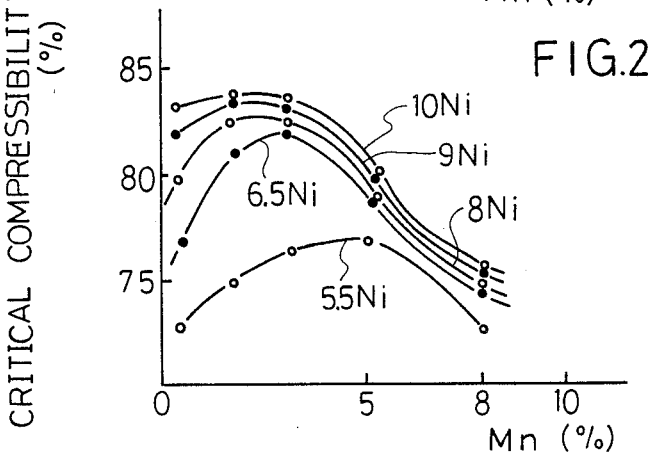
FIG. 2 is a graph illustrating the relationship of manganese content and critical compressibility.

FIG. 2 illustrates the relationship of critical compressibility and manganese and nickel content. Critical compressibility generally increases as the manganese content becomes larger. And, critical compressibility of stainless steels containing 6–10% nickel becomes the largest when the manganese content is 2–4%, and critical compressibility decreases sharply when the manganese content exceeds 4%. Critical compressibility generally increases with the increase of nickel content. This effect of nickel, however, is minor in 9–10% nickel stainless steel.

This phenomenon that cold workability is affected by nickel and manganese content, and the interaction thereof occurs because the stability of the metallurgical structure, rather than individual elements, plays the main role as a factor in the steels containing a small amount of carbon, silicon, and nitrogen and which possess a strong solution strengthening effect. When the nickel content is not more than 8%, $\gamma \rightarrow \alpha$ martensite transformations tend to occur because $\gamma$ phase is very unstable if carbon, silicon, and nitrogen contents are very low. But the $\gamma \rightarrow \alpha$ transformations are inhibited by increasing the manganese content, and thus the tensile strength and critical compressibility are enhanced. Whereas, when the manganese content equals or exceeds 6%, $\gamma \rightarrow \epsilon$ transformations, in addition to $\gamma \rightarrow \alpha$ transformations, tend to occur, and the tensile strength and critical compressibility decrease. And when the nickel content increases to about 9–10%, the $\gamma$ phase becomes stabilized. But the $\gamma \rightarrow \epsilon$ transformations are inhibited by increasing the manganese content, and the tensile strength and critical compressibility decrease.

Figure 3:
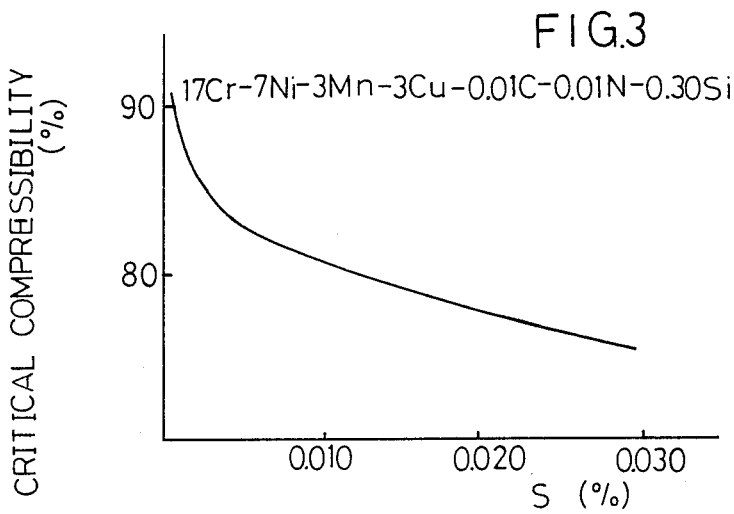
FIG. 3 is a graph illustrating the relationship of sulfur content and critical compressibility.

FIG. 3 illustrates the relationship of sulfur content and critical compressibility. Critical compressibility increases as the sulfur content decreases. It is notable that critical compressibility equals or exceeds 85% as the sulfur content is decreased to not more than 0.002%.

In order to produce economical stainless steels possessing a superior cold workability comparable to that of SUSXM7, carbon, silicon, and sulfur contents are decreased to a minimal level, and optimal levels of manganese and nickel content have been found.

Further the optimal manganese and nickel content have been found as a result of research on effects of nickel and manganese in relation to hot workability.

Figure 4:
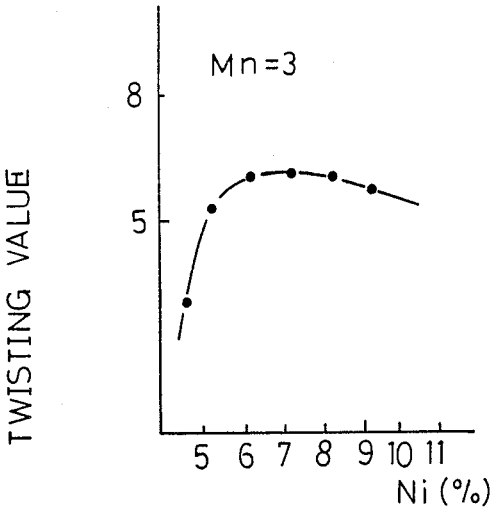
FIG. 4 is a graph illustrating the relationship of nickel content and twisting value.
Figure 5:
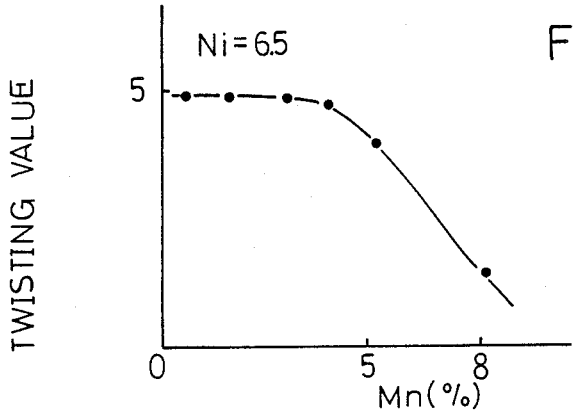
FIG. 5 is a graph illustrating the relationship of manganese content and twisting value.
Figure 6:
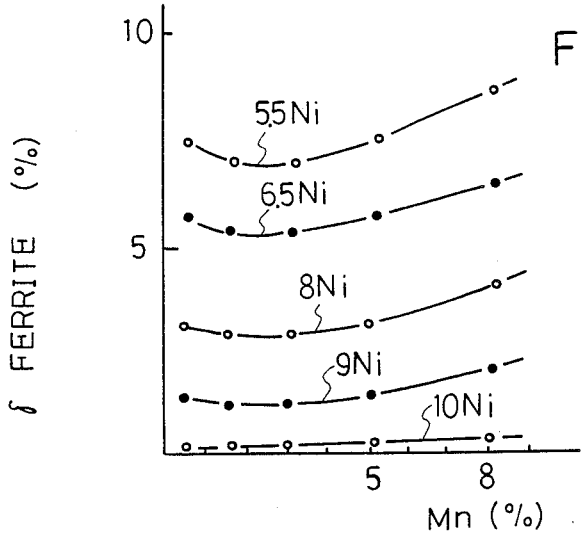
FIG. 6 is a graph illustrating the relationship of manganese content and δ ferrite content.

FIG. 4 and FIG. 5 illustrate the relationship of twisting value and nickel and manganese content of steels heated to 1,000° C. FIG. 6 illustrates the relationship of manganese content and $\delta$ ferrite content in steel ingots.

As indicated in FIG. 4, the twisting value of hot-worked steels becomes the largest when the nickel contents are 6–8%. The twisting value is very small when the nickel content is less than 6%. And, the twisting value generally decreases when the nickel content exceeds 8%. It means that steel ingots containing 6–8% nickel have a superior hot workability. That is why, as indicated in FIG. 6, the content of $\delta$ ferrite is only about 3–6% when the nickel content is 6–8% and further explains why $\delta$ ferrite disappears and becomes a single austenitic phase by the heat during rolling.

The twisting value is small when the nickel content is less than 6% because $\delta$ ferrite content in the steel ingot is large and a small percentage of $\delta$ferrite remains even after being subjected to the heat during rolling. The twisting value decreases when the nickel content exceeds 8% because the grain boundary segregation of such impurity elements as phosphorus and sulfur becomes large. Further the twisting value, as indicated in FIG. 5, sharply decreases when the manganese content exceeds 4%. And the twisting value decreases even more sharply due to the effect of high temperature brittling of manganese and copper when the manganese content exceeds 8%.

Figure 7:
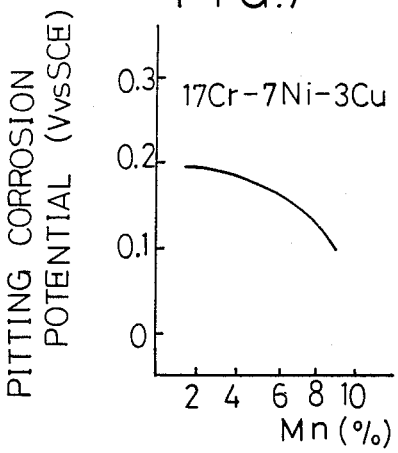
FIG. 7 is a graph illustrating the relationship of manganese content and pitting corrosion potential.
Figure 8:
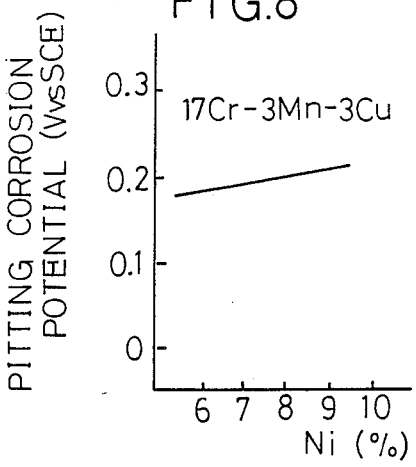
FIG. 8 is a graph illustrating the relationship of nickel content and pitting corrosion potential.
Figure 9:
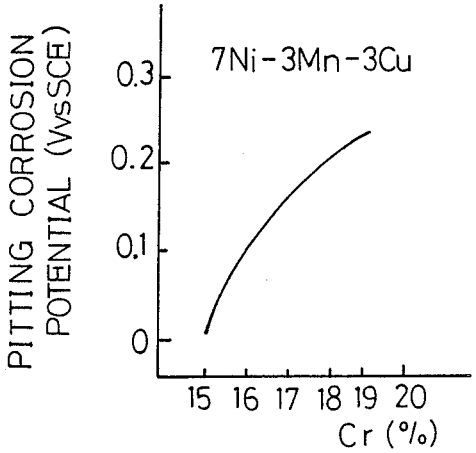
FIG. 9 is a graph illustrating the relationship of chromium content and pitting corrosion potential.

Chromium and sulfur contents appropriate for steels (including 2.2–3.8% manganese and 6–8% nickel) are found as a result of research on the effects of manganese, nickel, chromium, and sulfur in relation to corrosion resistance. FIG. 7, FIG. 8 and FIG. 9 illustrate the relationship of manganese, nickel, and chromium contents and pitting corrosion potential. The corrosion resistance is evaluated by the pitting corrosion potential of these steels which have been immersed in 3.5% NaCl aqueous solution at a temperature of 30° C. In addition, pitting corrosion potential not less than 0.250 V is required to produce sufficient corrosion resistance.

FIG. 7 shows that the pitting corrosion potential is constant at about 0.18 V when the manganese content is not more than about 4%. The pitting corrosion potential decreases sharply when the manganese content exceeds 4%, i.e., the corrosion resistance decreases sharply when the manganese content equals or exceeds 4%.

FIG. 8 shows that The pitting corrosion potential increases slightly as the nickel content increases between 6 and 10%.

The pitting corrosion potential in relation to chromium content of 7% Ni-3% Mn-3% Cu steel is illustrated in FIG. 9. The pitting corrosion potential equals or exceeds 0.15 V when the chromium content exceeds 17%. And, when the chromium content exceeds 17%, a superior corrosion resistance can be produced with an addition of about 3% manganese instead of nickel.

Figure 10:
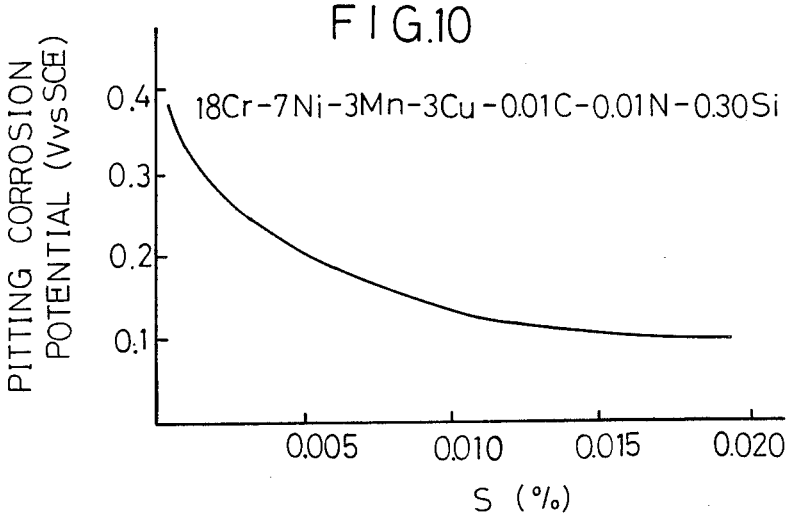
FIG. 10 is a graph illustrating the relationship of sulfur content and pitting corrosion potential.

FIG. 10 illustrates the relationship of pitting corrosion potential and sulfur content of 18 Cr-7 Ni-3 Mn-3 Cu-0.01 C-0.01 N-0.30 Si steel. The pitting corrosion potential increases as the sulfur content decreases. The pitting corrosion potential should equal or exceed 0.25 V in order to produce sufficient corrosion resistance. And it can be realized only when the sulfur content is reduced to not more than 0.002%, as can be seen in FIG. 10. In the steels of the present invention, the content of carbon, silicon and sulfur are extremely limited to not more than 0.04%, not more than 0.60%, and not more than 0.002%, respectively, while the contents of manganese, nickel and chromium are from 2.2–3.8%, from 6–8%, and not less than 17%, respectively. Thus the steels of the present invention are economical and yet comparable to SUSXM7 in possessing superior properties of cold workability, hot working and corrosion resistance.

The composition of the steels of the present invention is set forth hereunder.

Carbon is an element which (due to a solution strengthening effect) causes a decrease of cold workability and corrosion resistance. Therefore, in the present invention the carbon content should be limited to a minimal level, and the maximum carbon content is limited to not more than 0.04%. In addition, it is preferable to limit the maximum carbon content to not more than 0.02% in order to improve the cold workability further.

Although silicon is required for deoxidation in refining steels, silicon decreases cold workability when it is contained in an amount which is more than necessary. Therefore, the silicon content is limited to 0.60% at maximum. In addition, it is preferable to limit the silicon content to 0.20–0.40% in order to improve the cold workability further.

Manganese is an important element for producing cold workability as manganese affects the stability of austenitic phase of low carbon-low silicon austenitic steels. In a low nickel region, $\gamma \rightarrow \alpha$ martensite transformation is inhibited further and the cold workability improves as the manganese content increases. The manganese content should equal or exceed 2.2% in order to produce these effects. Therefore, the manganese content is limited to 2.2% at minimum.

Manganese, however, tends to cause $\gamma \rightarrow \epsilon$ martensite transformation and inhibits cold workability, hot workability and corrosion resistance when the manganese content equals or exceeds 3.8%. Therefore, the manganese content is limited to 3.8% at maximum.

Sulfur content should be limited to a minimal level. Sulfur greatly inhibits the corrosion resistance and cold workability of the steels of this invention. Therefore, the sulfur content is limited to 0.002% at maximum, and preferably the sulfur content should be limited to not more than 0.001%.

Nickel is an important element which improves the corrosion resistance and enhances the cold workability by stabilizing the austenitic phase and inhibiting $\gamma \rightarrow \alpha$ and $\gamma \rightarrow \epsilon$ transformations. Therefore, the nickel content should equal or exceed 6.0%. Nickel, however, is an expensive element and thus it should not be used more than necessary. Therefore, the nickel content is limited to 8.0% at maximum.

Chromium is the most important element in enhancing corrosion resistance, and the chromium content should equal or exceed 17%. As the chromium content increases, however, chromium causes an imbalance of $\alpha/\gamma$ in a high temperature region and a sharp decrease of hot workability, and chromium also inhibits cold workability. Therefore, the chromium content is limited to 19% at maximum.

Copper is an important element which enhances corrosion resistance in addition to stabilizing austenitic phase and inhibits $\gamma \rightarrow \alpha$ and $\gamma \rightarrow \epsilon$ martensite transformations and improves the cold workability. The copper content should equal or exceed 2.5%. As the copper content increases, however, the hot workability sharply decreases. Therefore, the copper content is limited to 4.0% at maximum.

Nitrogen content should be limited to a minimal level because nitrogen inhibits the cold workability due to its solution strengthening effect. Therefore, the nitrogen content is limited to 0.010% at maximum. In addition, it is preferable to limit the nitrogen content to not more than 0.0080% in order to improve the cold workability further.

DESCRIPTION OF THE PREFERRED EMBODIMENTS

The features of the steels of the present invention are further clarified hereunder by comparing the steels with conventional steels and other comparative steels.

Table 1 indicates the chemical composition of these sample steels.

TABLE 1

| | CHEMICAL COMPOSITION (WEIGHT %) | | | | | | | |
|---|---|---|---|---|---|---|---|---|
| | C | Si | Mn | S | Cu | Ni | Cr | N |
| A1 | 0.04 | 0.52 | 1.77 | 0.013 | | 10.20 | 18.35 | 0.015 |
| A2 | 0.04 | 0.46 | 1.05 | 0.010 | | 13.20 | 17.21 | 0.013 |
| A3 | 0.04 | 0.62 | 0.88 | 0.012 | 3.25 | 9.66 | 17.33 | 0.013 |
| A4 | 0.05 | 0.67 | 6.02 | 0.012 | 2.11 | 6.27 | 17.18 | 0.012 |
| A5 | 0.04 | 0.44 | 4.01 | 0.010 | 2.95 | 7.80 | 15.50 | 0.015 |
| B1 | 0.05 | 0.72 | 2.66 | 0.008 | 3.17 | 8.52 | 17.29 | 0.012 |
| B2 | 0.03 | 0.32 | 2.83 | 0.008 | 3.15 | 5.60 | 17.32 | 0.012 |
| B3 | 0.02 | 0.36 | 3.10 | 0.009 | 3.13 | 7.93 | 19.41 | 0.013 |
| B4 | 0.02 | 0.39 | 2.76 | 0.004 | 4.53 | 7.45 | 17.65 | 0.012 |
| C1 | 0.02 | 0.19 | 2.80 | 0.008 | 3.19 | 7.10 | 17.48 | 0.012 |
| C2 | 0.02 | 0.25 | 3.75 | 0.008 | 3.42 | 6.05 | 17.02 | 0.011 |
| C3 | 0.01 | 0.23 | 2.32 | 0.007 | 3.56 | 7.98 | 17.11 | 0.011 |
| C4 | 0.01 | 0.28 | 2.74 | 0.001 | 3.16 | 7.21 | 17.56 | 0.012 |
| C5 | 0.02 | 0.25 | 3.46 | 0.001 | 3.23 | 6.24 | 17.37 | 0.011 |

TABLE 1-continued

| | CHEMICAL COMPOSITION (WEIGHT %) | | | | | | | |
|---|---|---|---|---|---|---|---|---|
| | C | Si | Mn | S | Cu | Ni | Cr | N |
| C6 | 0.01 | 0.21 | 2.42 | 0.0005 | 3.12 | 7.89 | 17.18 | 0.012 |
| C7 | 0.01 | 0.25 | 2.96 | 0.0008 | 3.12 | 7.69 | 17.19 | 0.007 |
| C8 | 0.02 | 0.20 | 3.05 | 0.001 | 3.40 | 7.23 | 17.42 | 0.008 |

TABLE 2

| | TENSILE STRENGTH (kg/mm$^2$) | CRITICAL COMPRESS-IBILITY (%) | HOT WORK-ABILITY | CORROSION RESISTANCE (V) |
|---|---|---|---|---|
| A1 | 60 | 73 | O | 0.28 |
| A2 | 53 | 80 | O | 0.24 |
| A3 | 51 | 84 | O | 0.18 |
| A4 | 56 | 77 | O | 0.10 |
| A5 | 54 | 81 | O | 0.085 |
| B1 | 54 | 88 | O | 0.167 |
| B2 | 56 | 86 | X | 0.172 |
| B3 | 55 | 85 | X | 0.233 |
| B4 | 47 | 92 | X | 0.188 |
| C1 | 50 | 86 | O | 0.172 |
| C2 | 51 | 85 | O | 0.175 |
| C3 | 49 | 87 | O | 0.185 |
| C4 | 50 | 93 | O | 0.342 |
| C5 | 51 | 92 | O | 0.325 |
| C6 | 49 | 95 | O | 0.381 |
| C7 | 48 | 95 | O | 0.367 |
| C8 | 48 | 95 | O | 0.333 |

In Table 1, steels A1–A5 are conventional steels, of which steel A1 is SUS 304, steel A2 is SUS305J1, steel A3 is SUSXM7, steel A4 is SUSXM1 and steel A5 is a 8 Ni-15.5 Cr-4 Mn-3 Cu steel. Steels B1–B4 are comparative steels. Steels C1–C8 are steels of the present invention. Steels C1–C3 are first group steels of the present invention, steel C4–C6 are second group steels of the present invention and steel C7 and steel C8 are third group steels of the present invention.

Table 2 indicates tensile strength, critical compressibility, hot workability and corrosion resistance of the sample steels shown in Table 1. The tensile strength was tested with the No. 4 test pieces of Japanese Industrial Standards. Critical compressibility was measured with $10\phi \times 155$ mm test pieces which had been heated at a temperature of 1,050° C. for 30 minutes and then processed by water-quench solid solution heat treatment. As for hot workability, ingots of the sample steels were heated at a temperature of 1,250° C. and then performed blooming roll. Those steels in which cracks did not occur during the process are indicated by O. And, X indicates the occurrence of cracks. The corrosion resistance was evaluated by measuring pitting corrosion potentials of the sample steels in a 30° C. aqueous solution of 3.5% NaCl.

In Table 2, the conventional steels A1 and A2 are inferior in cold workability because they do not contain copper. The conventional steel A4 is inferior in cold workability and corrosion resistance because it contains 6% manganese and a very small amount of copper. The conventional steel A5 is inferior in corrosion resistance and cold workability because it contains a small amount of chromium and a large amount of manganese.

Comparative steel B1 is inferior in cold workability because it contains a large amount of carbon and silicon. Comparative steel B2 is inferior in cold workability because its nickel content is low. Comparative steel B3 is inferior in hot workability and cold workability because it contains a large amount of chromium. Comparative steel B4 is inferior in hot workability because it contains a large amount of copper.

As opposed to these steels, the steels C1–C8 of the present invention possess superior cold workability; a tensile strength of 48–51 kg/mm$^2$ and critical compressibility of 85–95%. The present steels C1–C8 also possess superior hot workability as indicated by O in Table 2; there were no occurrences of cracks during blooming roll. The present steels C4–C8 further possess a superior corrosion resistance. The pitting corrosion potential of the present steels C4–C8, respectively, exceeds 0.250 V. It is apparent that these effects are due to less content of sulfur.

It is apparent from the above that the steels of the present invention are superior not only in cold workability but also in hot workability and corrosion resistance.

In order to enhance the cold workability of the steels of the present invention, the carbon, silicon, and sulfur contents are decreased, and manganese is contained without inhibiting the cold and hot workabilities based on the results of a research on the effect of nickel and manganese to the cold and hot workabilities. The corrosion resistance of the steels of this invention is also enhanced as a result of a research on nickel and chromium content appropriate for producing the same. Therefore, the stainless steels of this invention are economical and yet comparable to SUSXM7 in possessing superior cold workability, corrosion resistance and hot workability, and they can be employed in extensive practical applications.

What is claimed is:

1. A cold working stainless steel having a tensile strength of not more than 51 kg/mm$^2$, a critical compressibility of at least 92% and consisting essentially of, by weight ratio, not more than 0.04% carbon, not more than 0.60% silicon, from 2.2 to 3.8% manganese, not more than 0.001% sulfur, from 3.0 to 4.0% copper, from 6 to 8% nickel, from 17 to 19% chromium, and not more than 0.012% nitrogen, the remainder being iron together with impurities.

2. A cold working stainless steel according to claim 1, wherein the nitrogen content is not more than 0.010%.

3. A cold working stainless steel according to claim 1, wherein the content of said carbon is not more than 0.02%, the content of said silicon is not more than 0.40%, and the content of said sulfur is not more than 0.001%.

4. A cold working stainless steel according to claim 1, wherein the content of said carbon is not more than 0.02%, the content of said silicon is not more than 0.40%, the content of said sulfur is not more than 0.001%, the content of said copper is 3.0–4.0%, and the content of said nickel is 7.0–8.0%.

5. A cold working stainless steel according to claim 1, wherein the content of said carbon is not more than 0.02%, the content of said silicon is not more than 0.40%, the content of said sulfur is not more than 0.001%, and the content of said nitrogen is not more than 0.0080%.

6. A cold working stainless steel according to claim 1, wherein the content of said carbon is not more than 0.02%, the content of said silicon is not more than 0.40%, the content of said sulfur is not more than 0.001%, the content of said copper is 3.0–4.0%, the content of said nickel is 7.0–8.0% and the content of said nitrogen is not more than 0.0080%.

* * * * *